US010821353B2

(12) United States Patent
Pfeffer et al.

(10) Patent No.: US 10,821,353 B2
(45) Date of Patent: Nov. 3, 2020

(54) COLOR OR PATTERN MATCHING TOY

(71) Applicant: Huntar Company, Union City, CA (US)

(72) Inventors: Klause Pfeffer, Muecke (DE); Peer Clahsen, Schopfheim (DE)

(73) Assignee: Huntar Company, Inc., Union City, CA (US)

( * ) Notice: Subject to any disclaimer, the term of this patent is extended or adjusted under 35 U.S.C. 154(b) by 0 days.

(21) Appl. No.: 16/501,320

(22) Filed: Mar. 27, 2019

(65) Prior Publication Data

US 2020/0306622 A1 Oct. 1, 2020

(51) Int. Cl.
*A63F 9/08* (2006.01)

(52) U.S. Cl.
CPC ..... *A63F 9/0865* (2013.01)

(58) Field of Classification Search
CPC .... A63F 9/0865; A63F 9/0873; A63F 9/0826; A63F 9/0834; A63F 9/0604; A63F 9/0602; A63F 9/08; A63F 9/0838; A63F 9/0842
USPC ..... 273/153 S
See application file for complete search history.

(56) References Cited

U.S. PATENT DOCUMENTS 1,518,889 A * 12/1924 Wooster ..... A63F 3/0423 273/153 S
2,001,067 A * 5/1935 Lane ..... A63F 9/0873 273/153 R
2,967,714 A * 1/1961 Calabrese ..... A63F 3/00261 273/271
4,540,177 A * 9/1985 Horvath ..... A63F 9/0834 273/153 S
5,116,052 A * 5/1992 Pop ..... A63F 9/0842 273/153 R
6,386,540 B1 * 5/2002 Stevkovski ..... A63F 9/0834 273/153 S
6,773,011 B1 * 8/2004 Rom ..... A63F 9/0865 273/153 S
D501,034 S * 1/2005 Rom ..... D21/478
(Continued)

FOREIGN PATENT DOCUMENTS

GB 2206053 A * 12/1988 ..... A63F 9/0873
WO WO-2015139303 A1 * 9/2015 ..... A63F 5/048

OTHER PUBLICATIONS

"Popular Playthings: Toys for Learning and Toys for Fun", <http://www.popularplaythings.com/index.php?controller=aboutus>, retrieved on Jul. 21, 2020. (Year: 2020).*
(Continued)

*Primary Examiner* — Steven B Wong
(74) *Attorney, Agent, or Firm* — Jonathan E. Grant; Grant Patent Service

(57) ABSTRACT

A matching toy is taught containing a sphere and a cube. The cube has six sides, and each of the six sides has an opening, and each side having a marking. The sphere is positioned within the cube, such that when the sphere is within the cube, a cap of said sphere projects out each opening. There are a plurality of markings on a plurality of the caps of the sphere such that when positioned, each cap is capable of being matched with the at least one marking on each side of the cube. In another embodiment, each section of the cube matches the color or pattern of a specific corner of the cube. In another embodiment, instead of a cube, another polygon can be used. Similarly, a sphere within a sphere is disclosed.

6 Claims, 22 Drawing Sheets

(56) References Cited

U.S. PATENT DOCUMENTS

| | | | | |
|---|---|---|---|---|
| 6,883,802 | B2 * | 4/2005 | Rom | A63F 9/0819 273/153 S |
| 8,651,488 | B2 * | 2/2014 | Mulholland | A63F 3/00214 273/153 R |
| 2002/0105139 | A1 * | 8/2002 | Ficinski | A63F 9/0873 273/157 R |

OTHER PUBLICATIONS

"Popular Playthings: Toys for Learning and Toys for Fun: Cubel", <http://www.popularplaythings.com/index.php?controller=search&orderby=position&orderway=desc&search_query=cubel&submit_search=Search>, retrieved on Jul. 21, 2020. (Year: 2020).*

* cited by examiner

COLOR OR PATTERN MATCHING TOY

A color or pattern matching toy is disclosed wherein a ball is rotated within a geometric form until colors or patterns of the rotating ball are matched with the patterns or colors on the geometric form.

and

Figure 1:
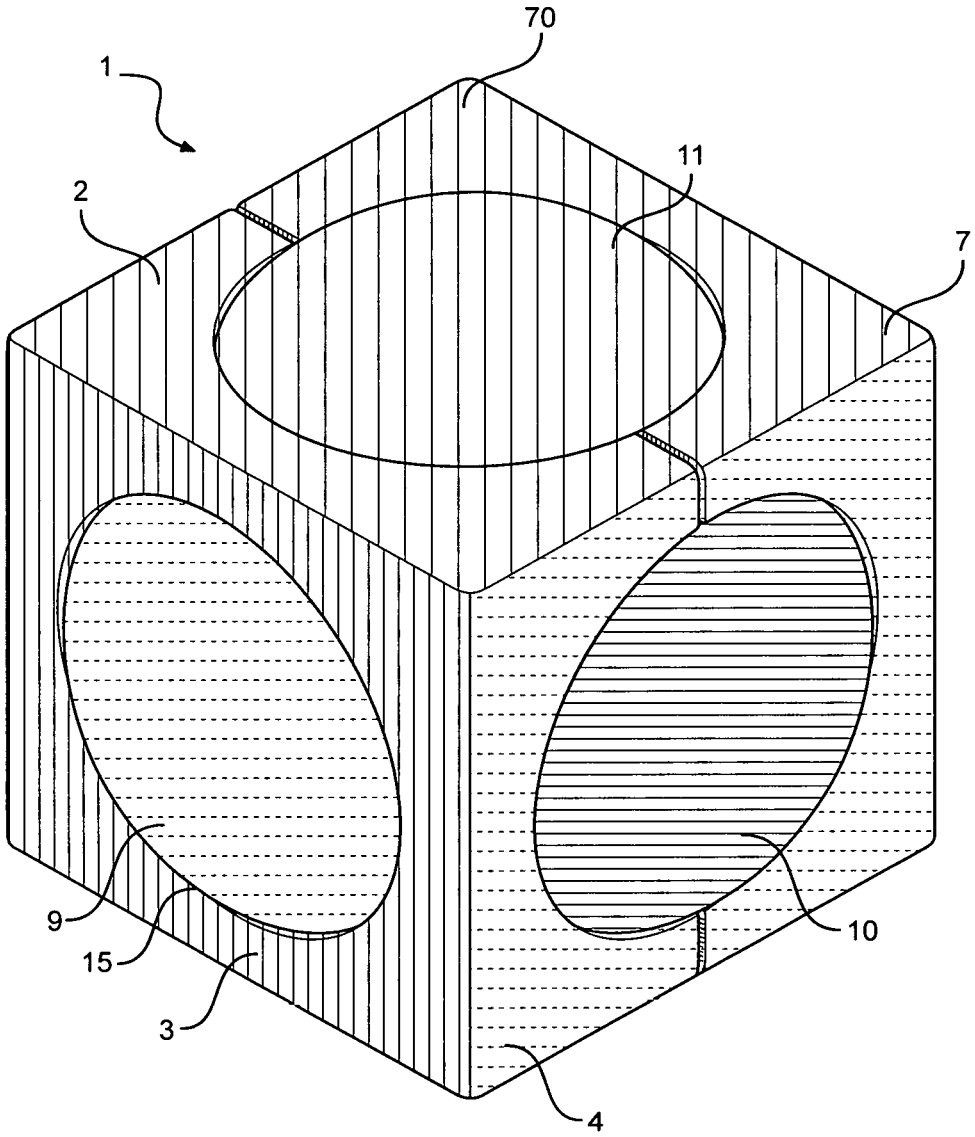
FIG. 1 is a top perspective view of the matching c toy.
Figure 2:
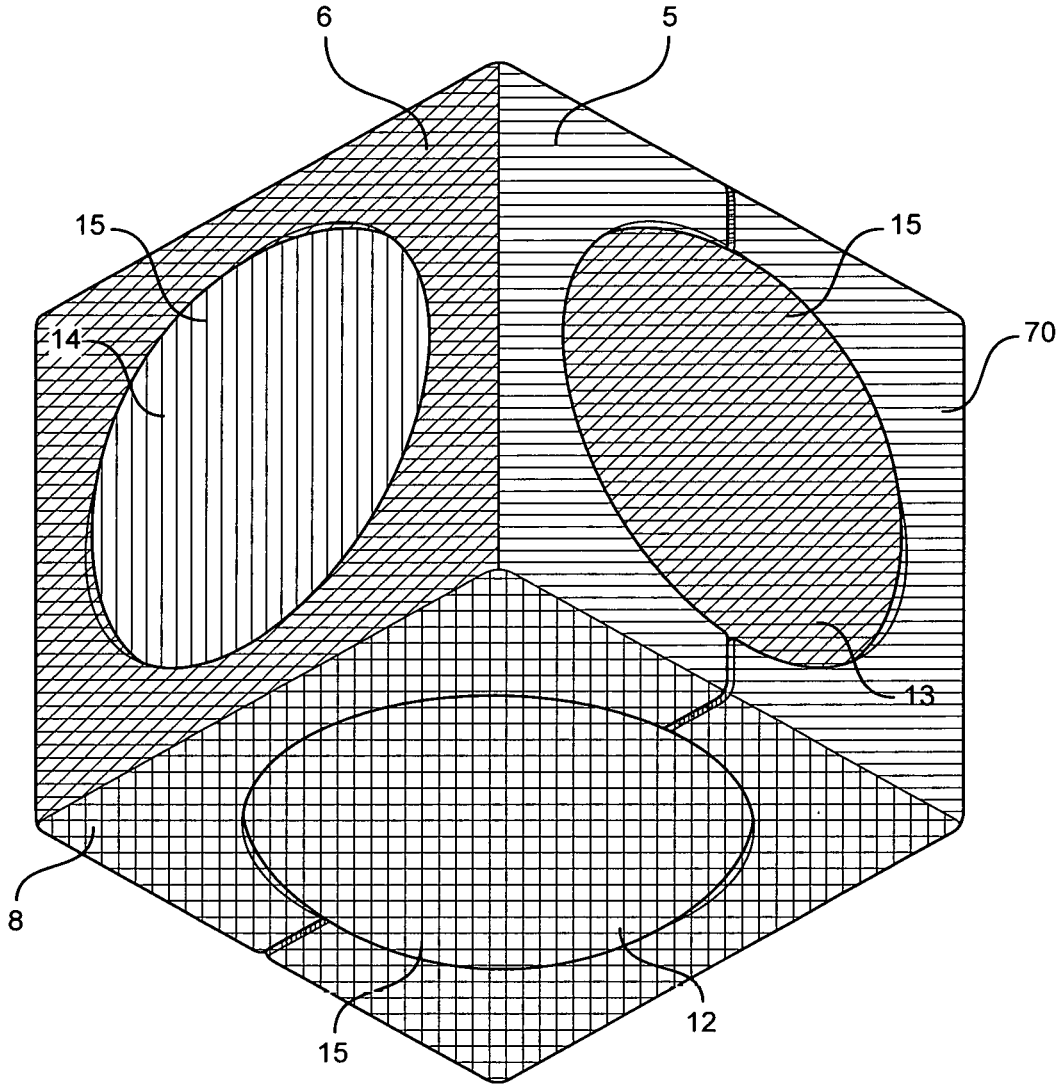
FIG. 2 is a bottom perspective view of the matching toy.
Figure 3:
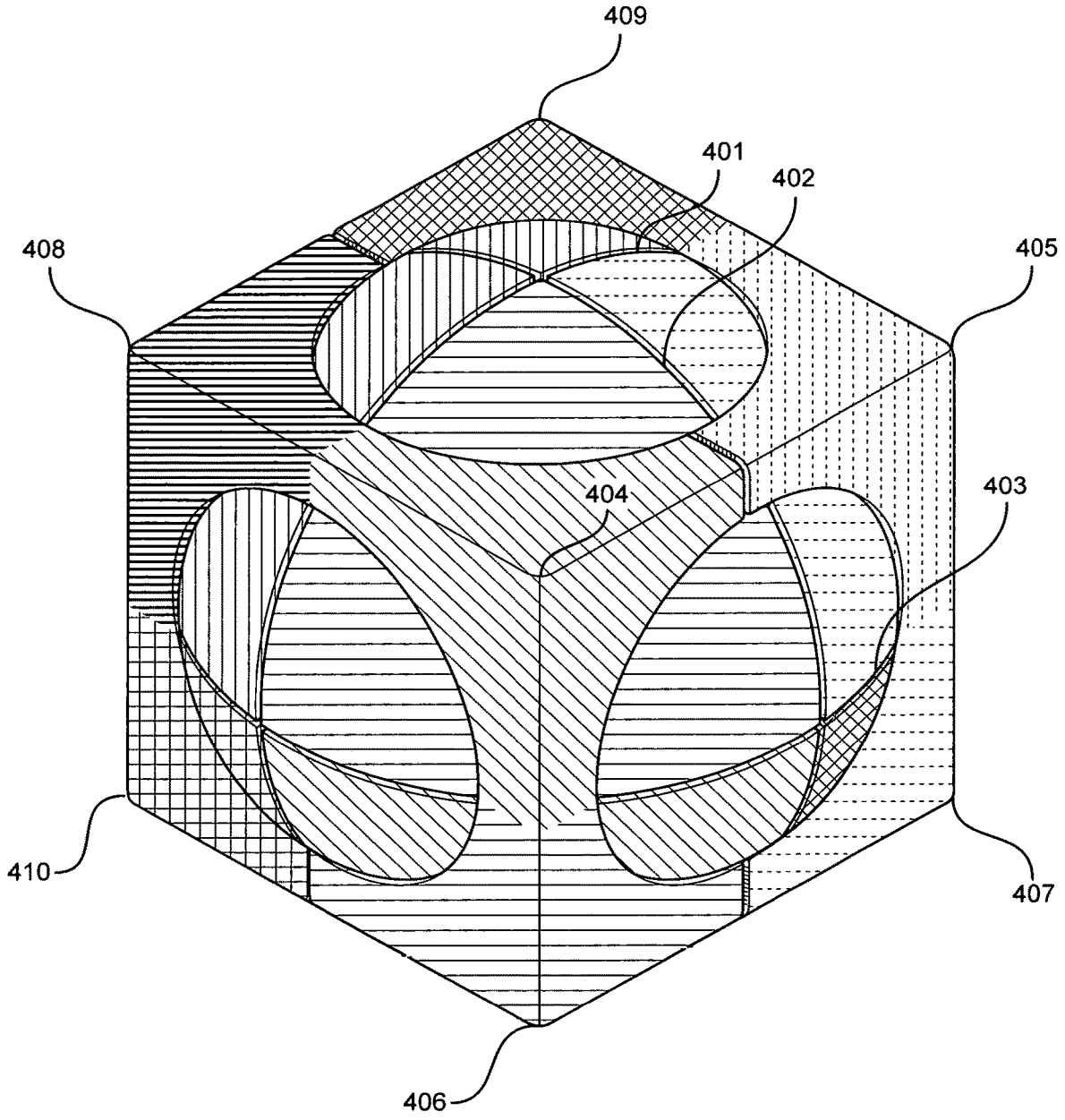
FIG. 3 is a top perspective view of the matching toy with eight different colors.
Figure 4:
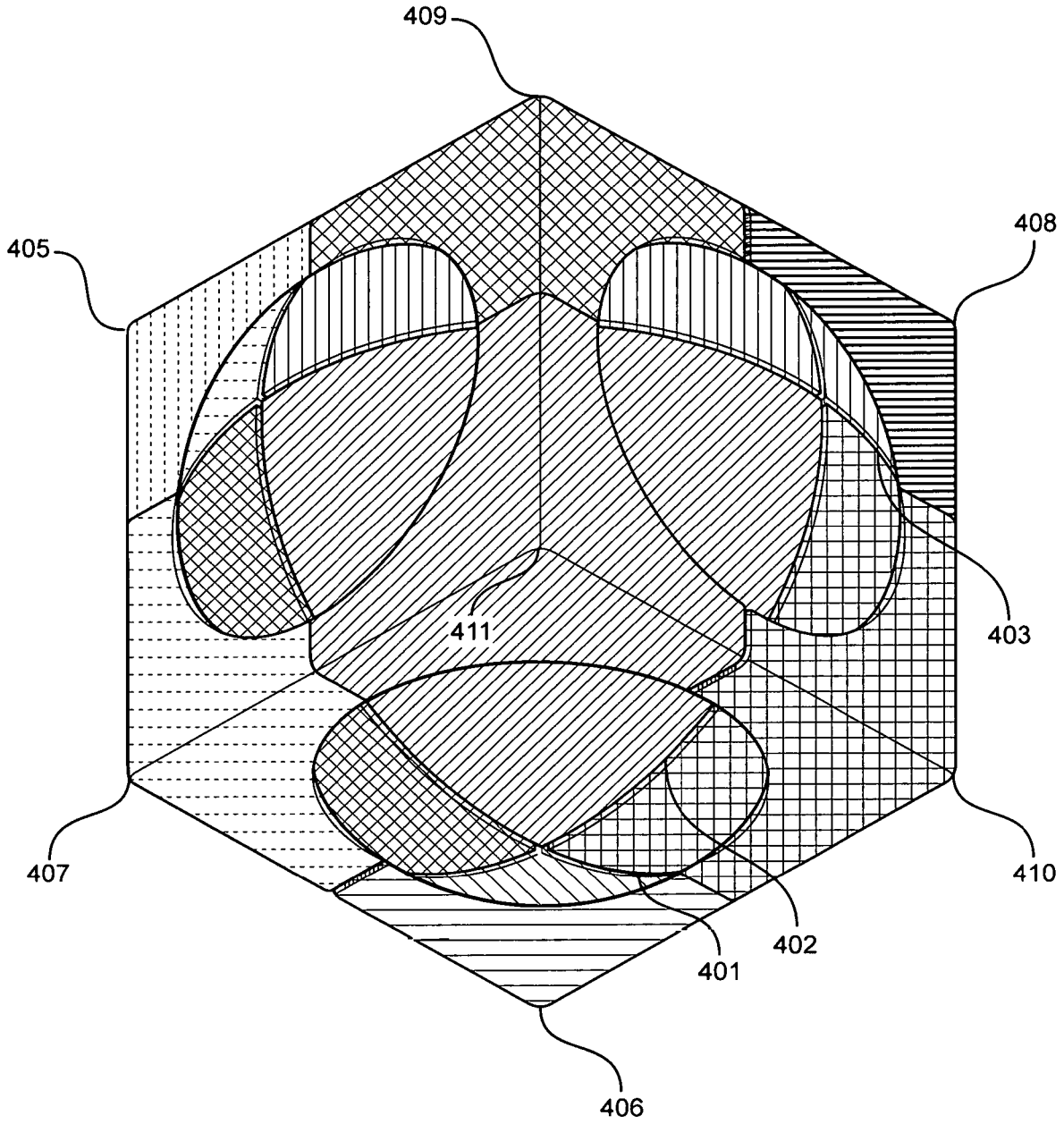
FIG. 4 is a bottom perspective view of the matching toy with eight different colors
Figure 5:
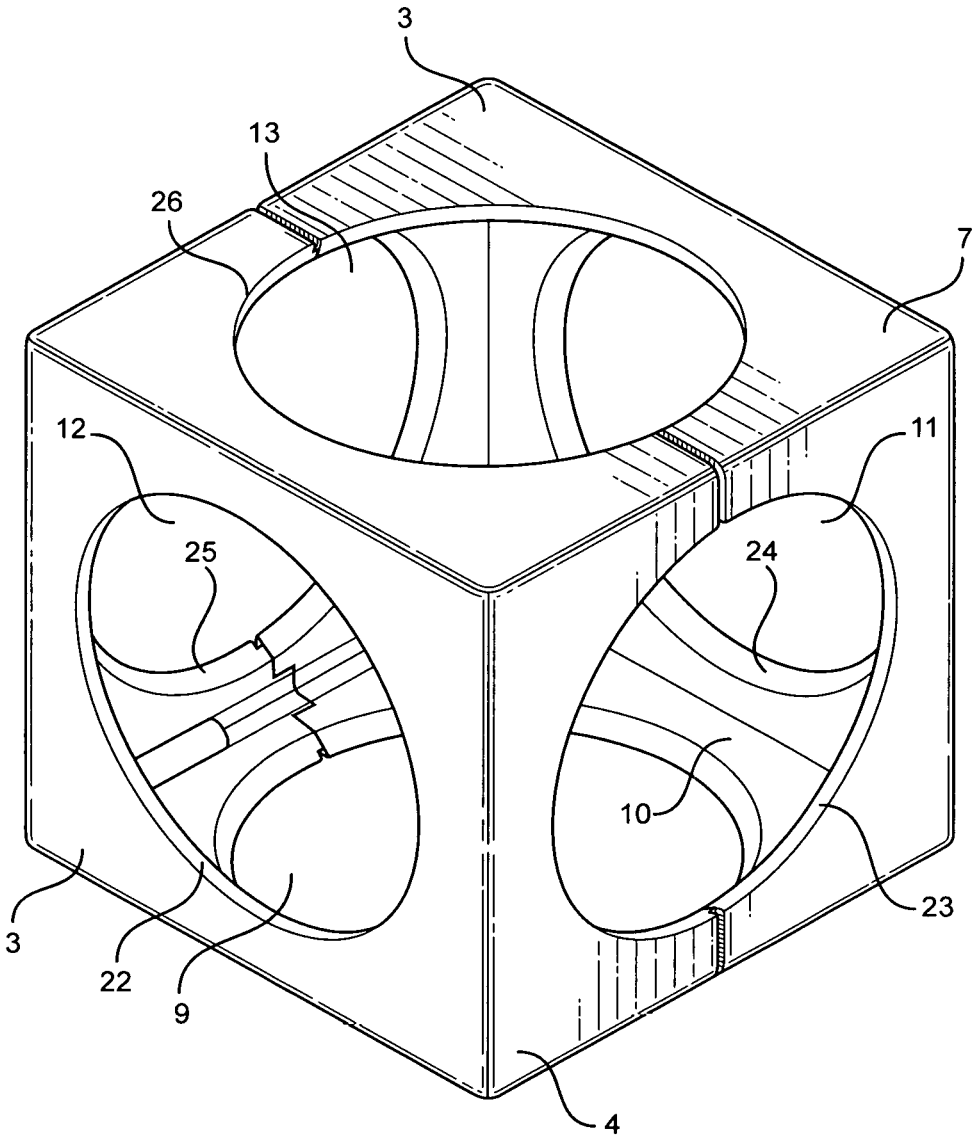
FIG. 5 is a top perspective view of the cube of the matching toy.
Figure 6:
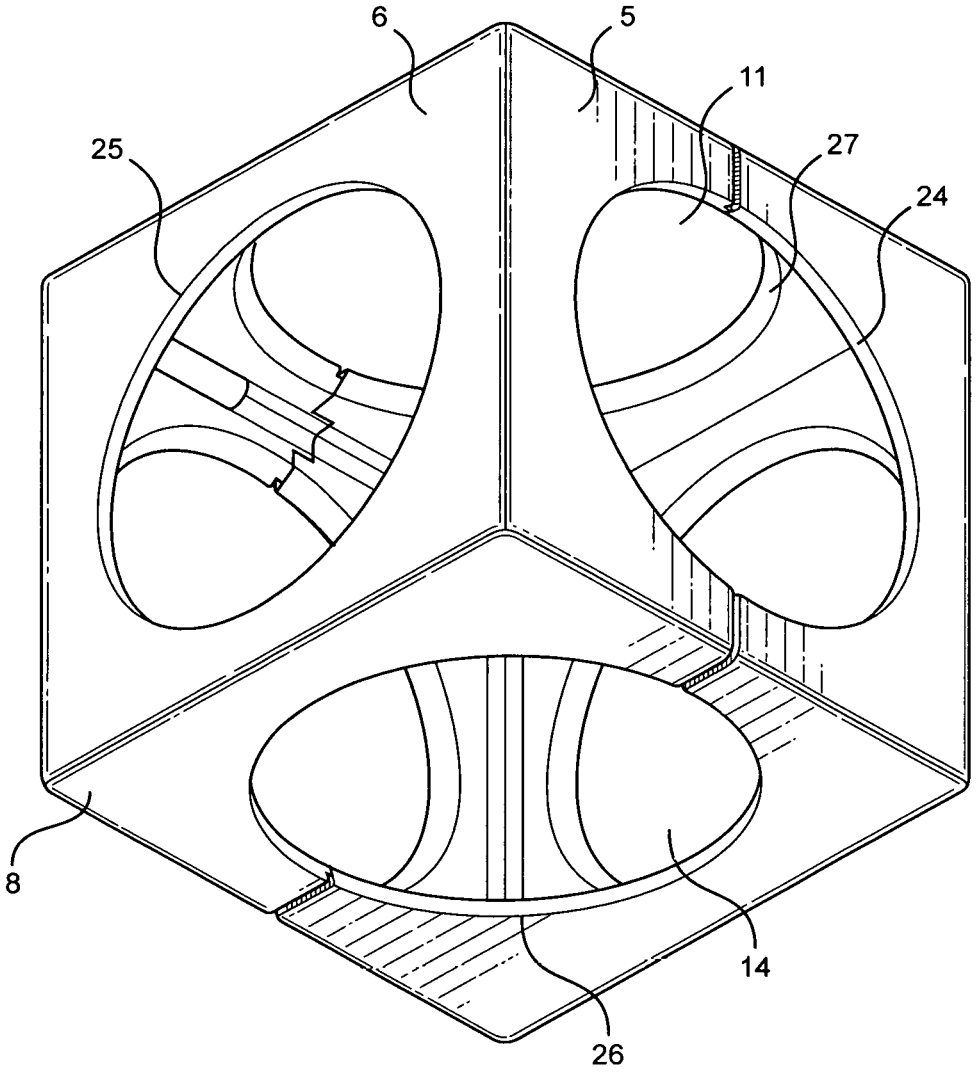
FIG. 6 is a bottom perspective of the cube of the matching toy.
Figure 7:
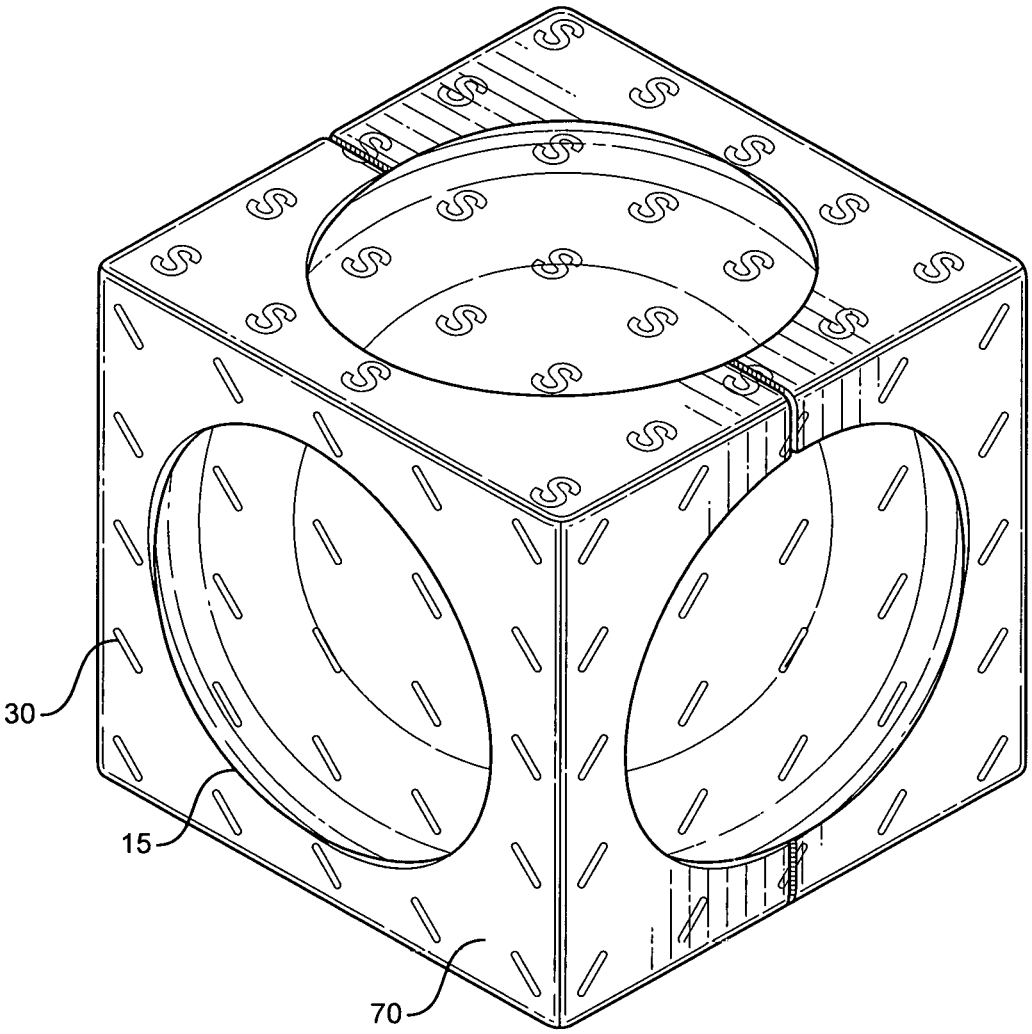
FIG. 7 is a perspective view of the matching toy with matching shapes.
Figure 8:
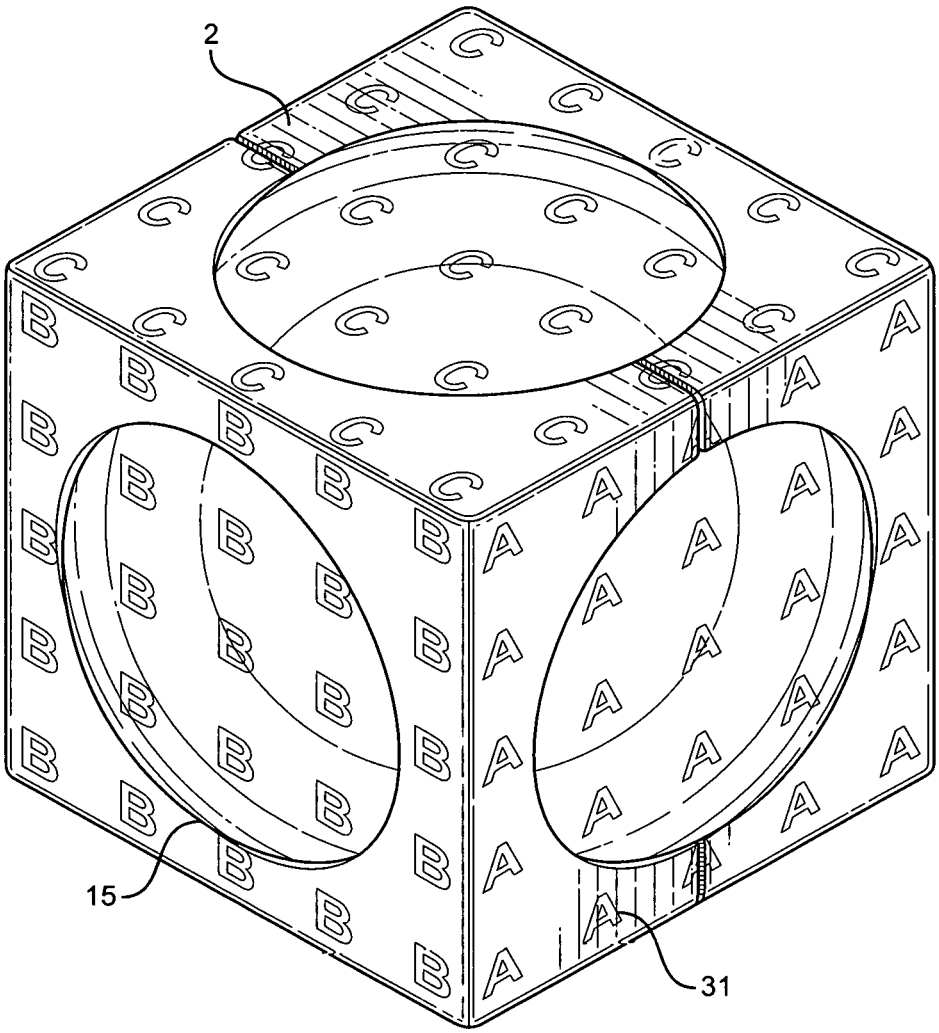
FIG. 8 is a perspective view of the matching toy with matching letters.
Figure 9:
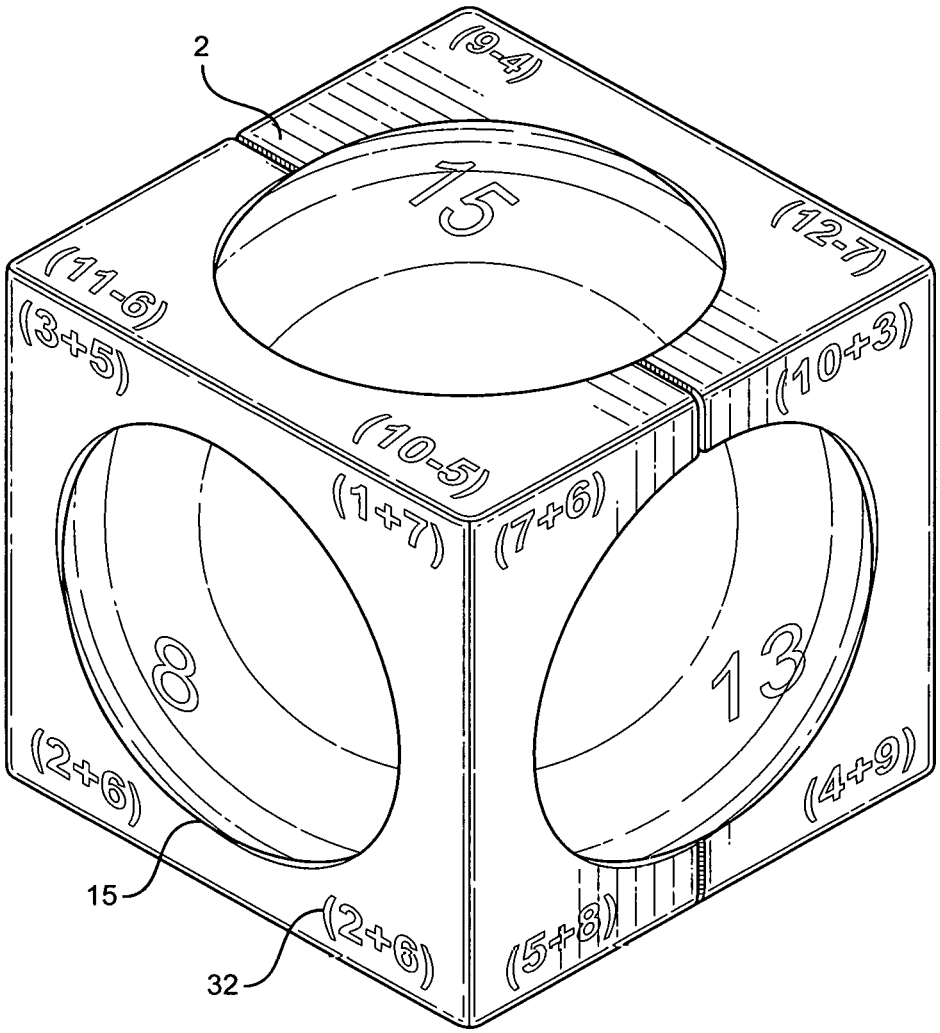
FIG. 9 is a perspective view of the matching toy with matching numbers.
Figure 10:
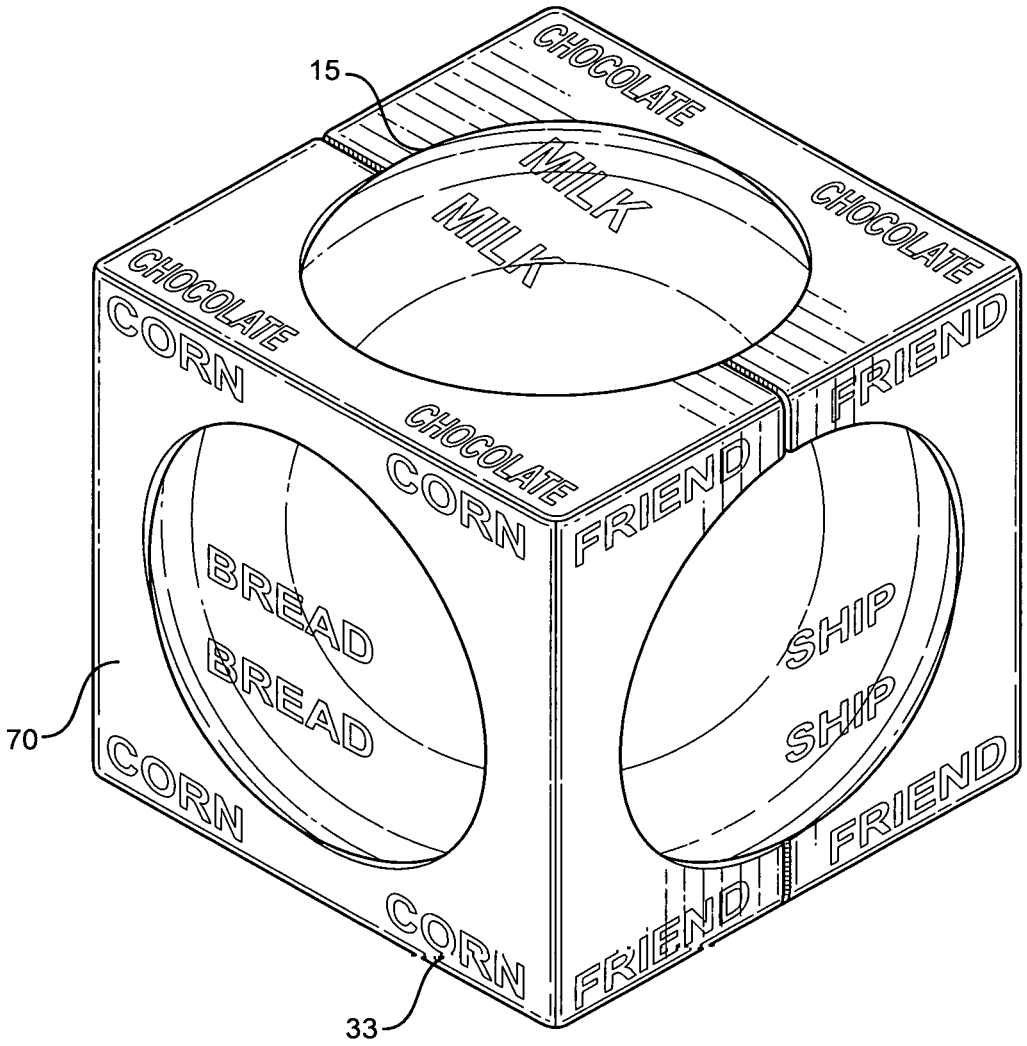
FIG. 10 is a perspective view of the matching toy with matching words.
Figure 11:
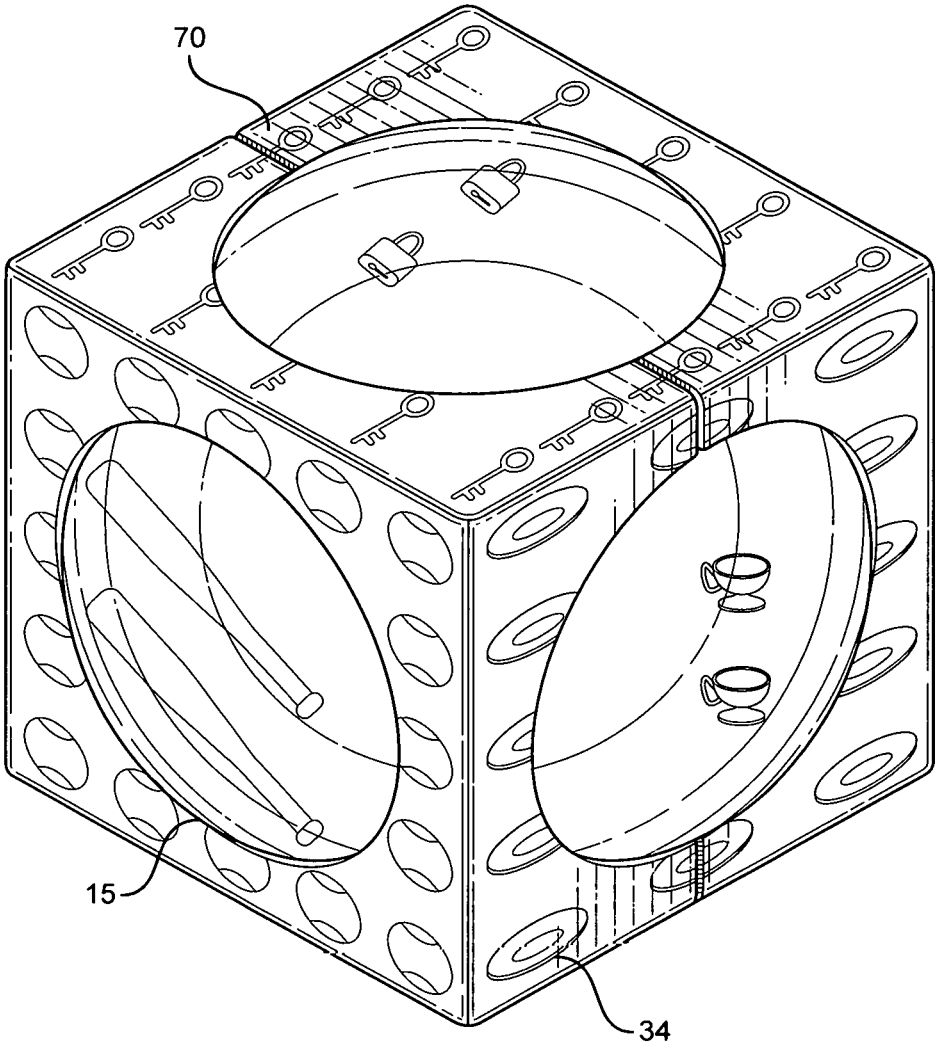
FIG. 11 is a perspective view of the matching toy with matching objects.
Figure 12:
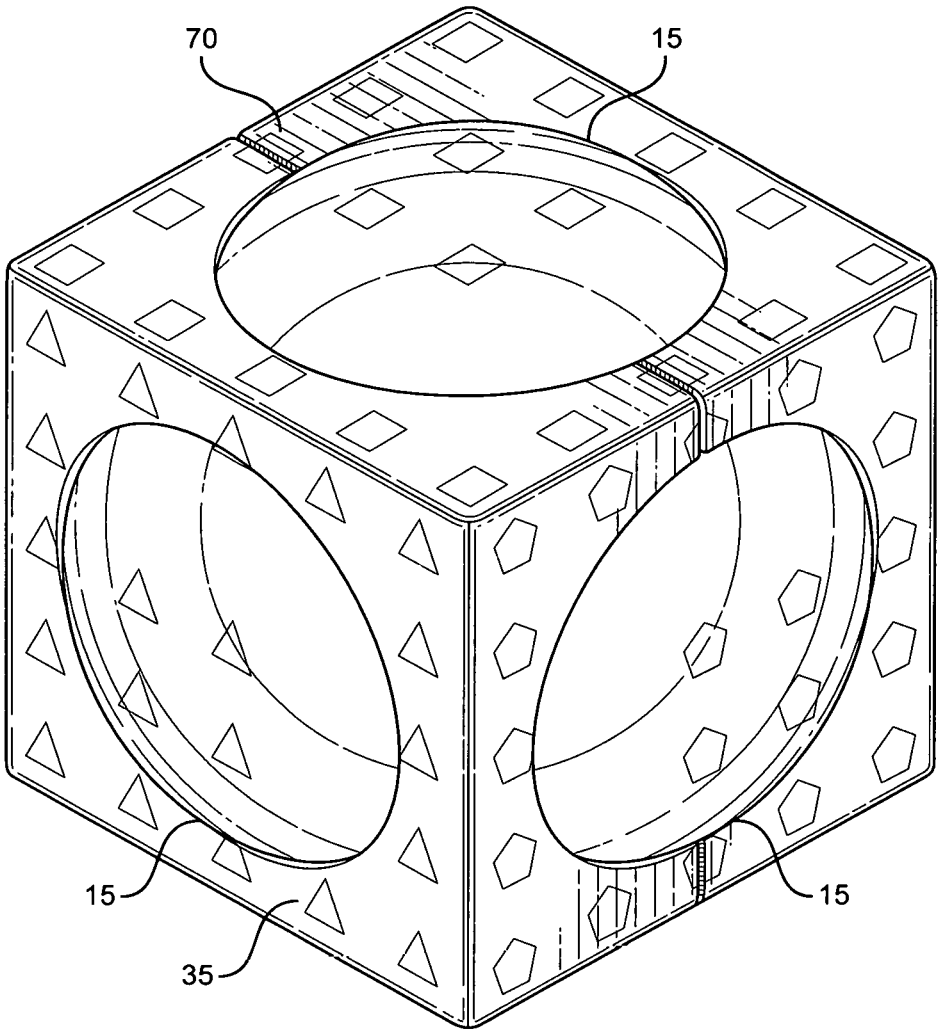
FIG. 12 is a perspective view of the matching toy with matching geometric images.
Figure 13:
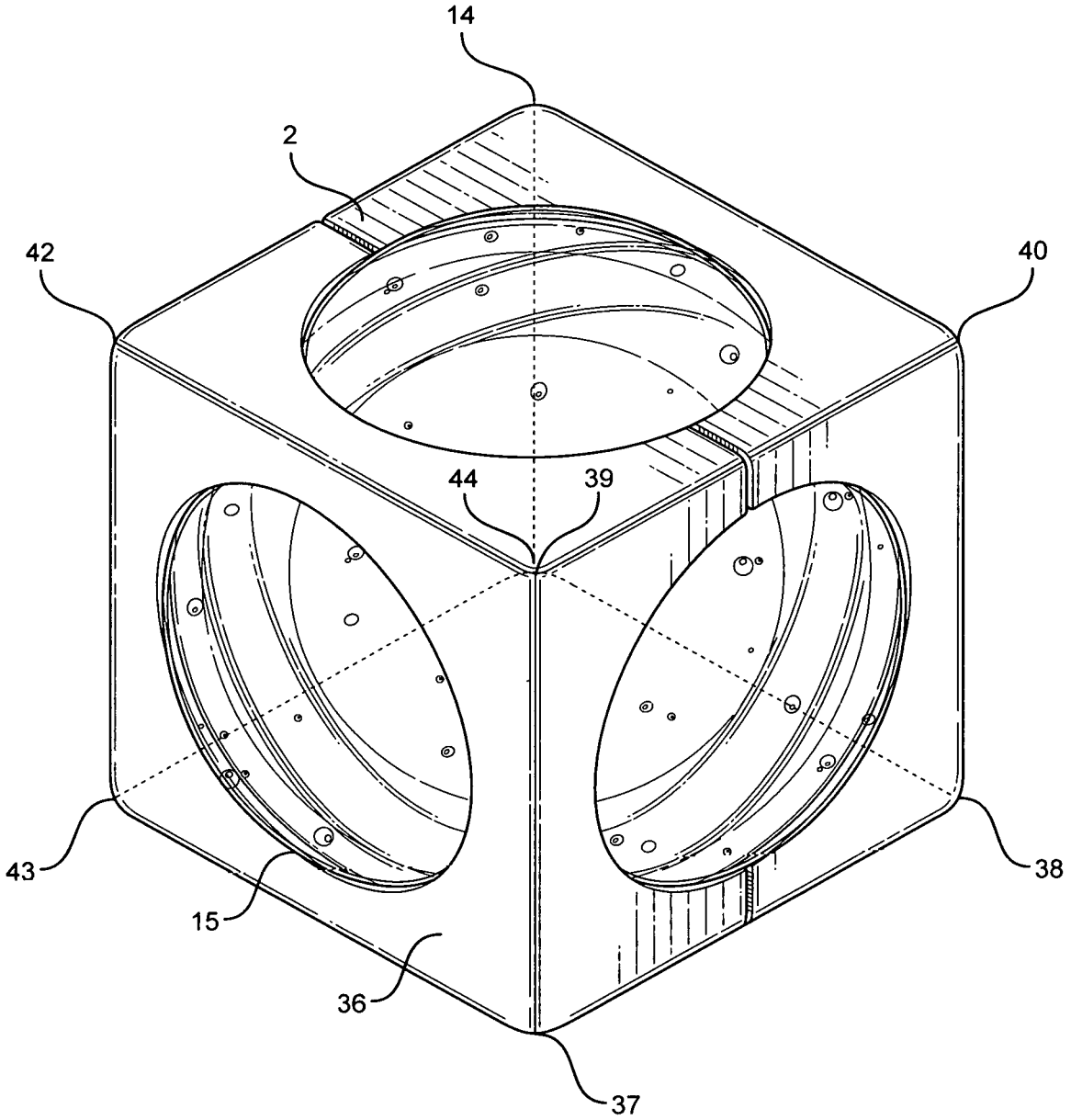
FIG. 13 is a perspective view of another embodiment of the cube of the matching toy.
Figure 14:
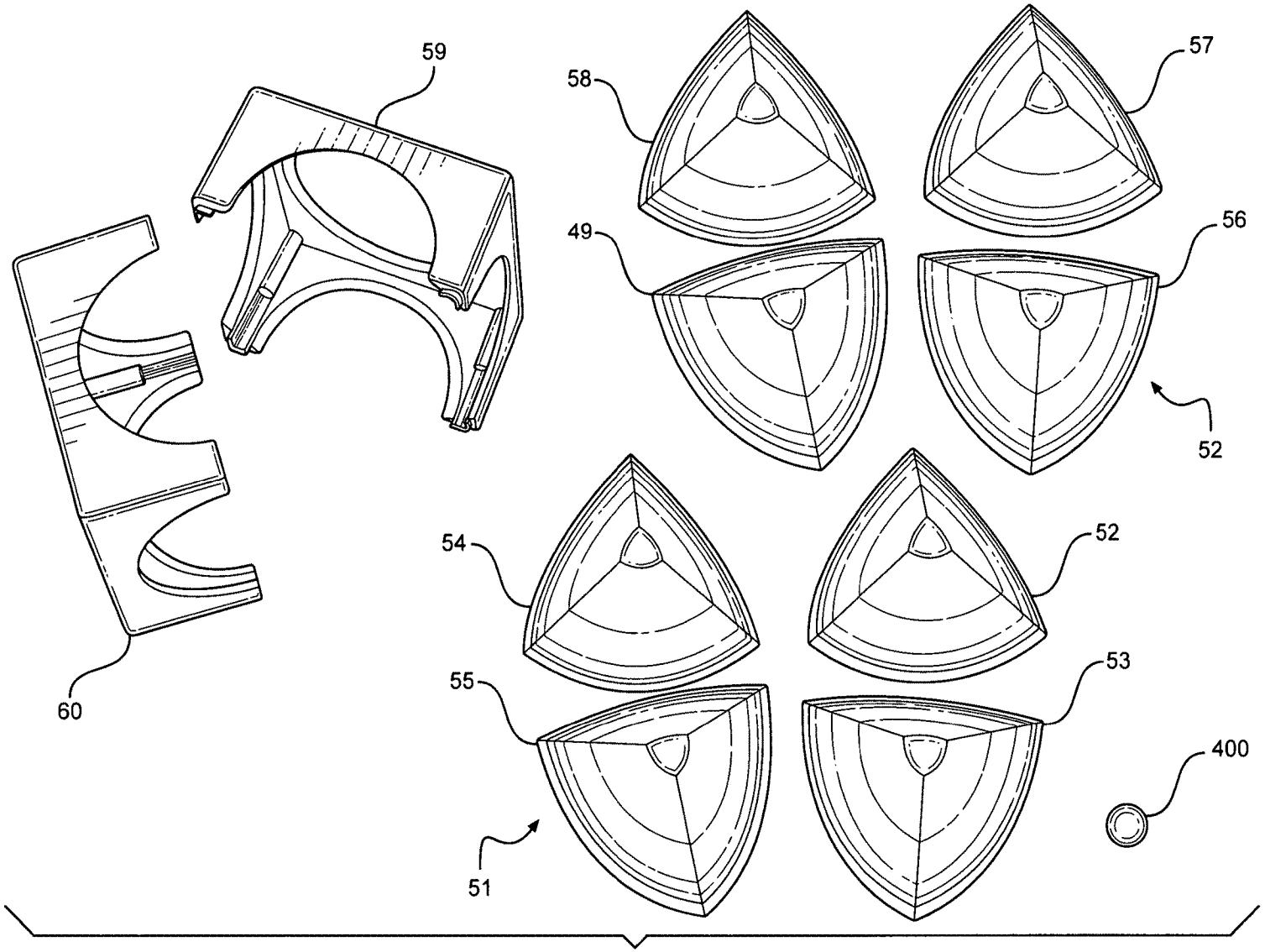
FIG. 14 is a perspective view of the parts of one embodiment of the matching toy.
Figure 15:
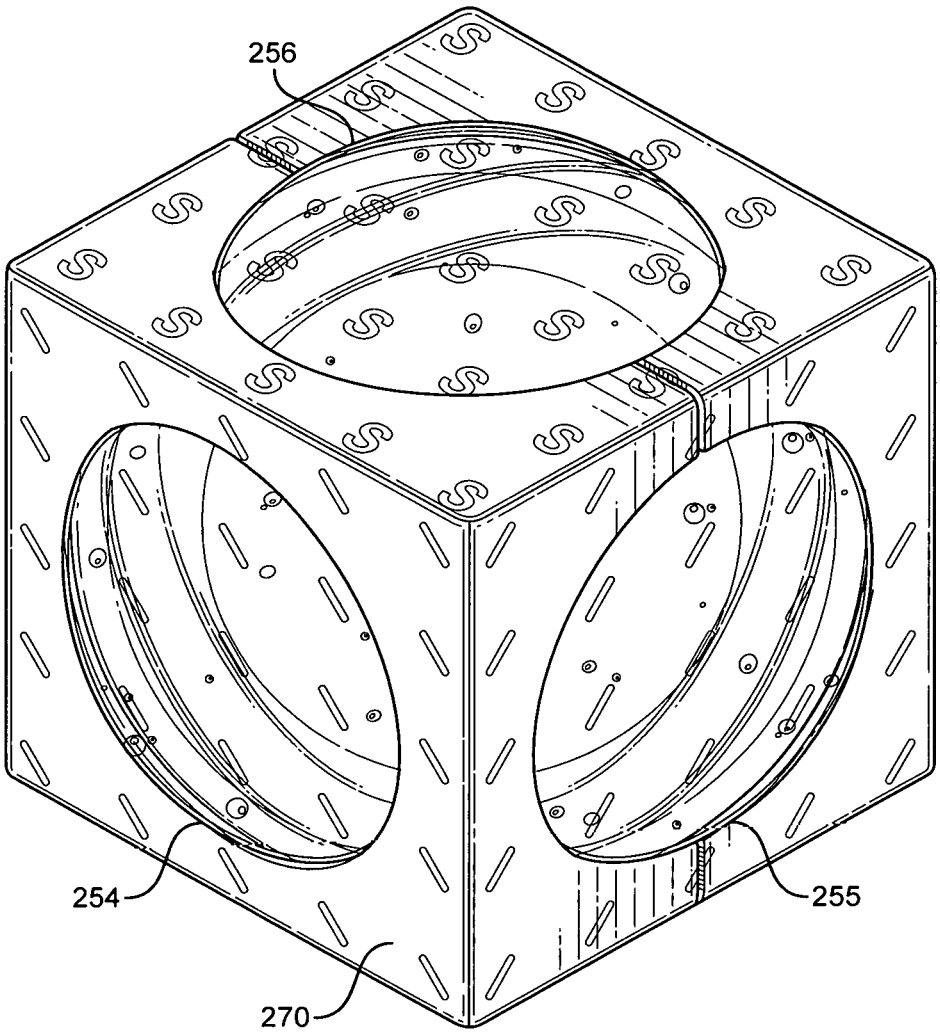
FIG. 15 is a perspective view of the cube of an alternative embodiment of the matching toy.
Figure 16:
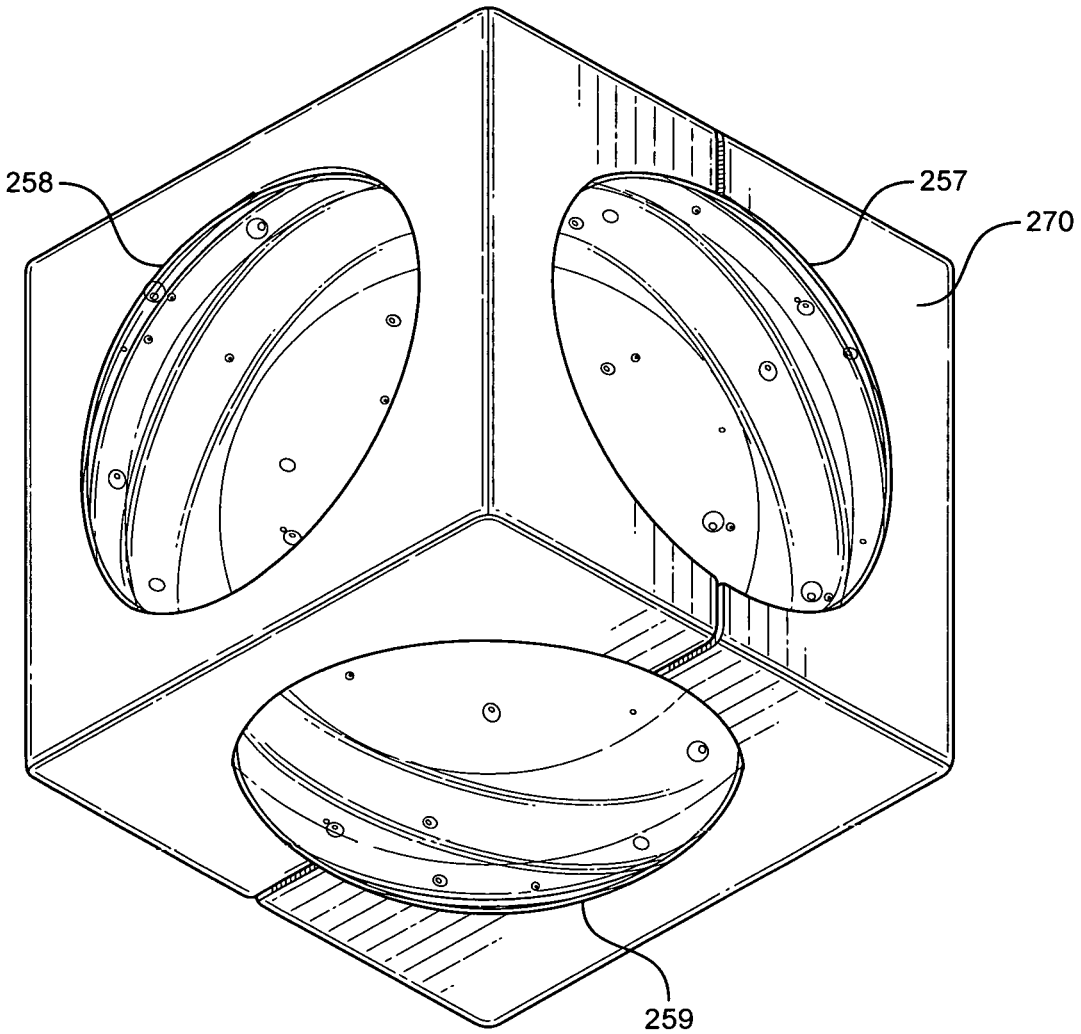
FIG. 16 is a perspective view of the bottom of the bottom of the cube of the alternative embodiment of the matching toy.
Figure 17:
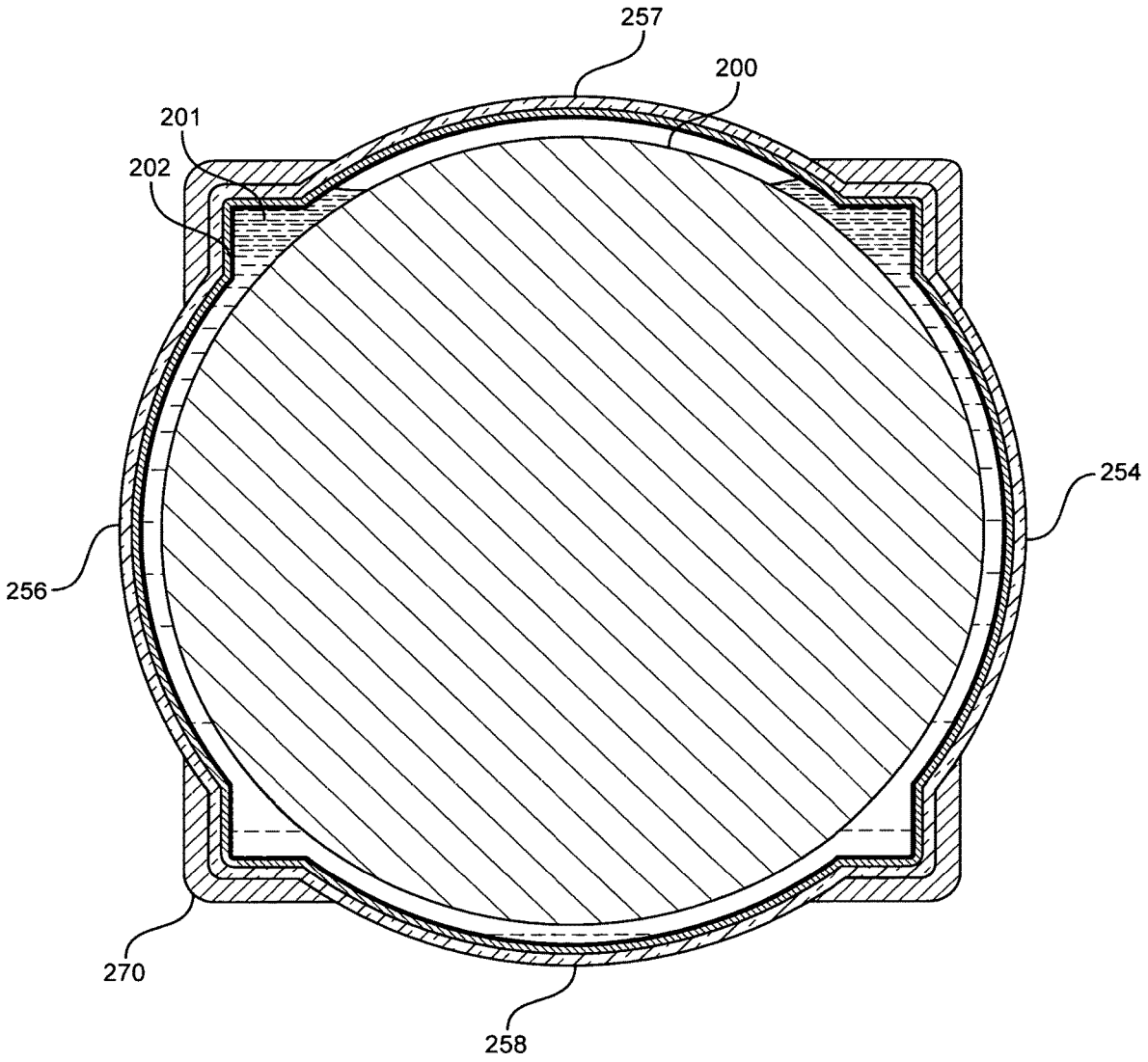
FIG. 17 is a cross section of of the alternative embodiment of FIG. 14 of the matching toy.
Figure 18:
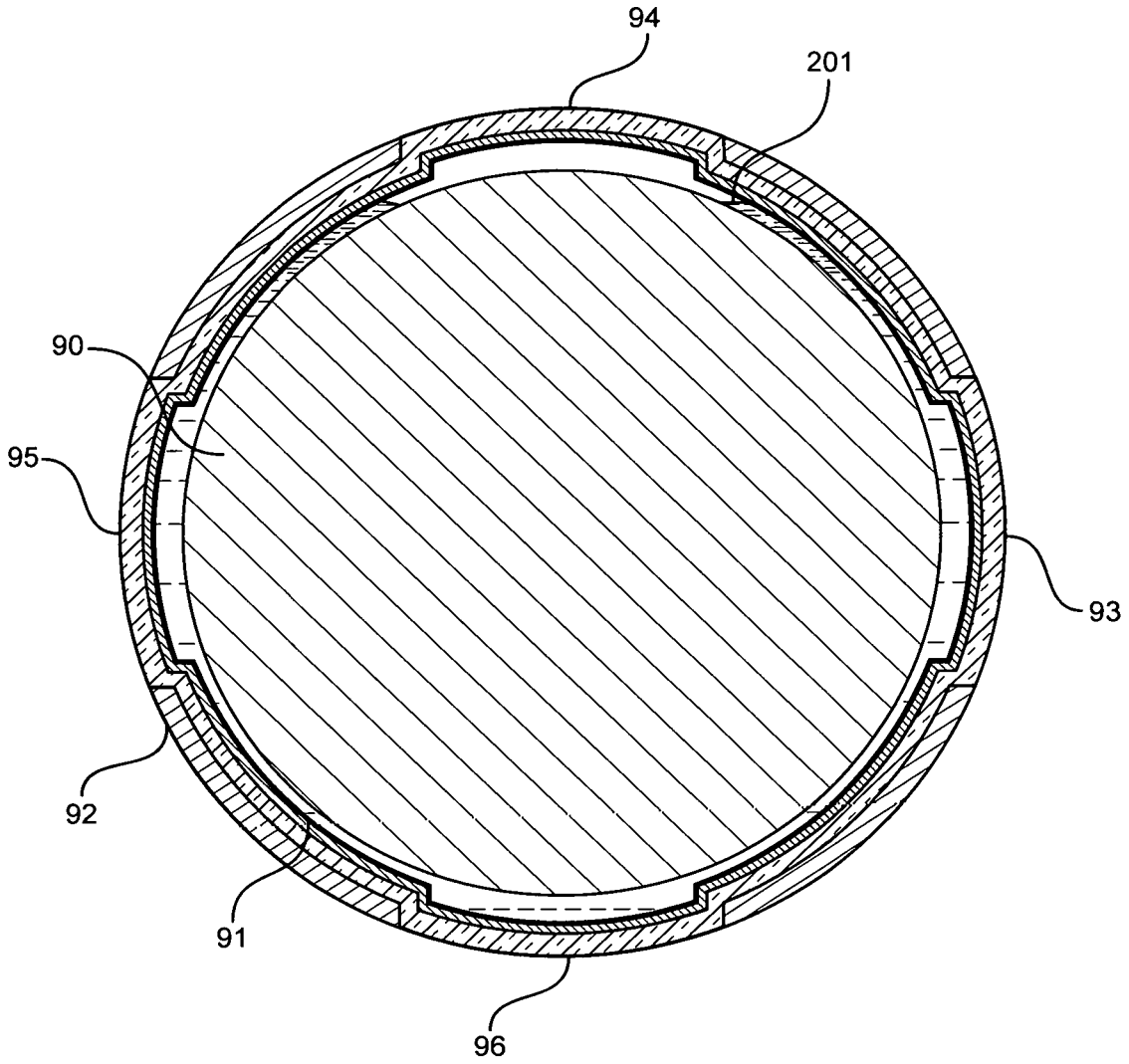
FIG. 18 is a cross-section of an alternative embodiment of the matching toy.
Figure 19:
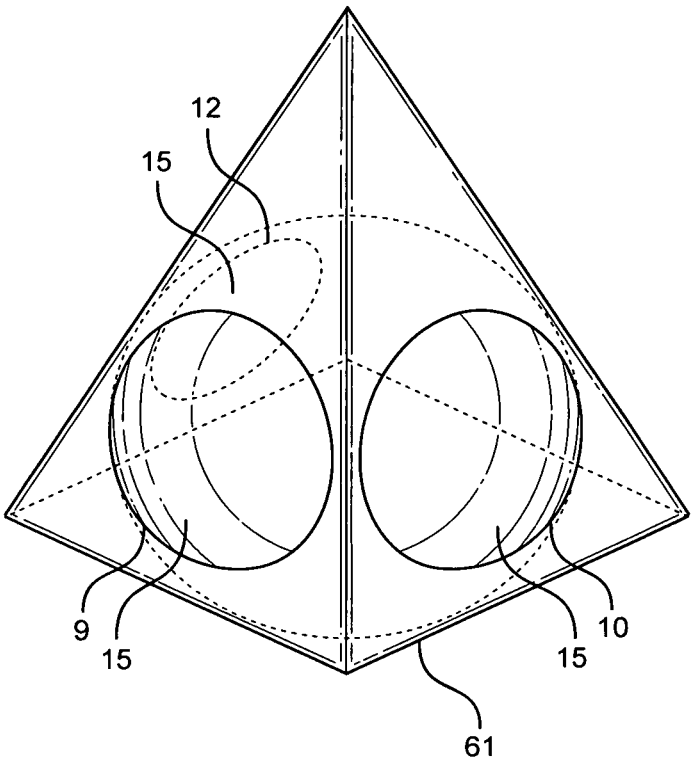
FIG. 19 is a perspective view of a pyramid embodiment of the shell.
Figure 20:
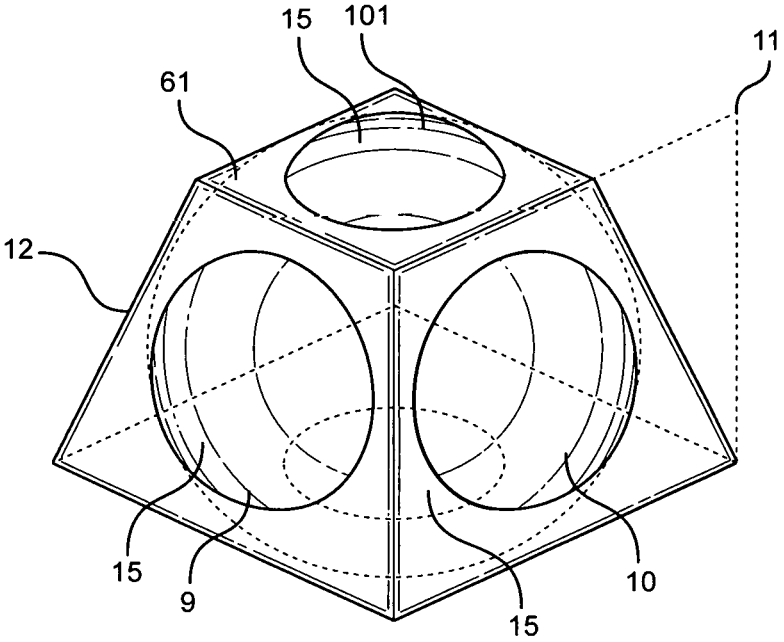
FIG. 20 is a perspective view of another embodiment of the pyramid shell in FIG. 17.
Figure 21:
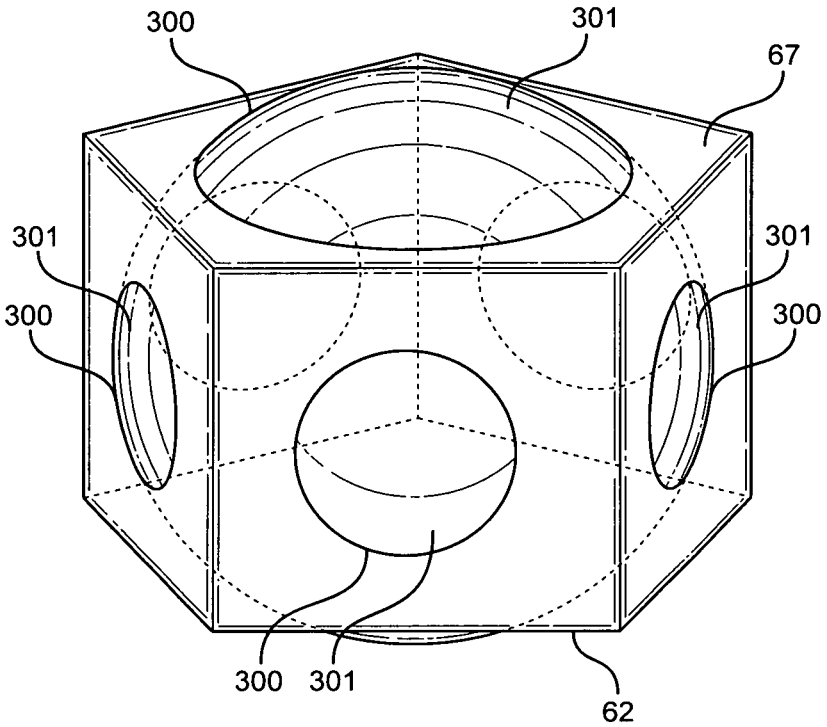
FIG. 21 is a perspective view of a pentagon embodiment of the shell of the matching toy.
Figure 22:
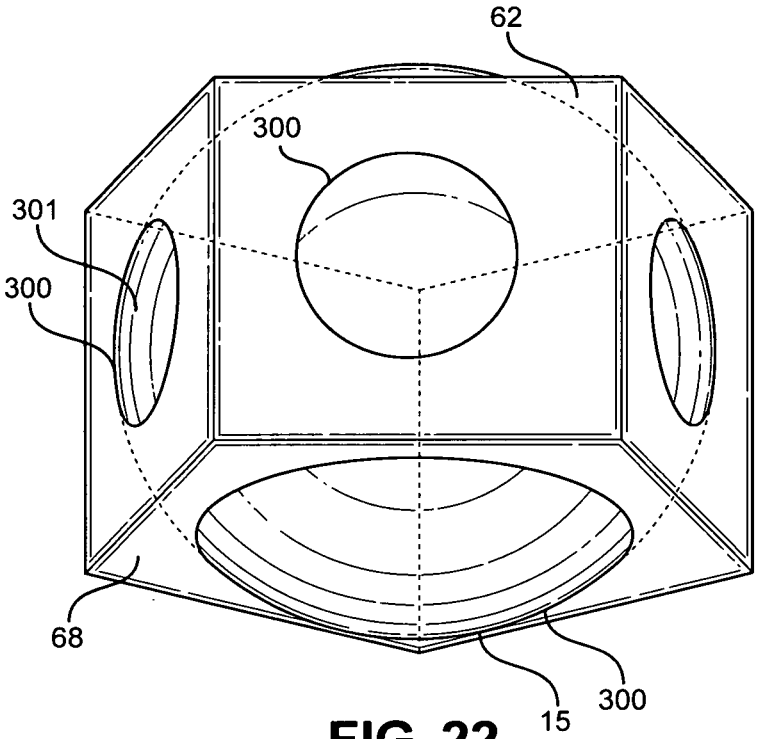
FIG. 22 is a bottom view of the pentagon embodiment of FIG. 19.
Figure 23:
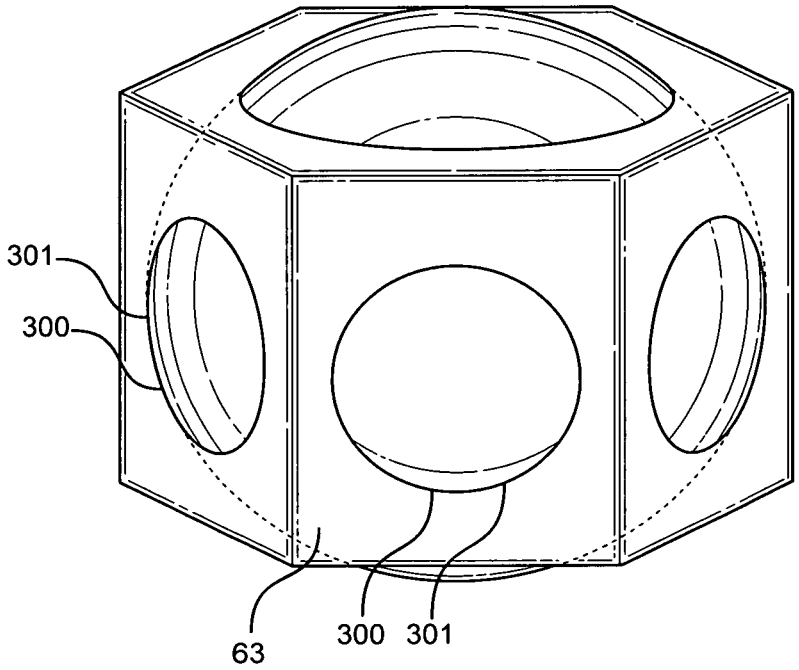
FIG. 23 is a perspective view of a hexagon embodiment of the shell of the matching toy.
Figure 24:
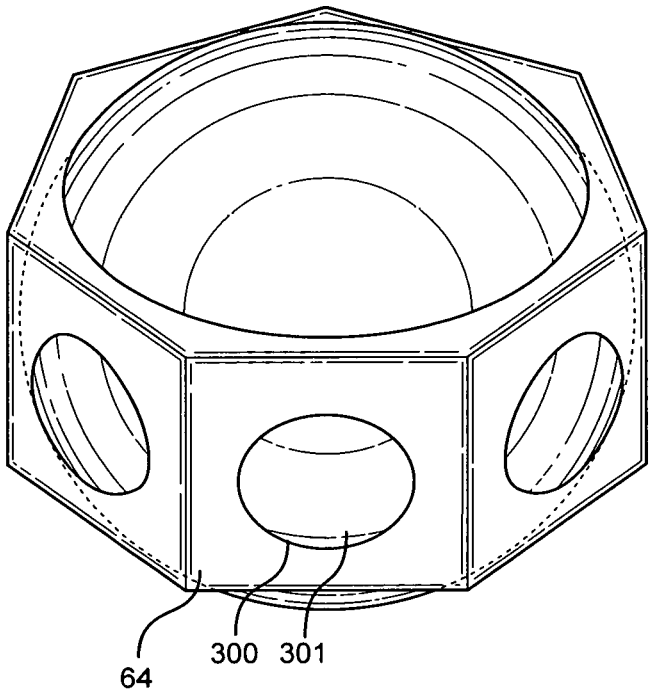
FIG. 24 is a perspective view of a heptagon embodiment of the shell of the matching toy.
Figure 25:
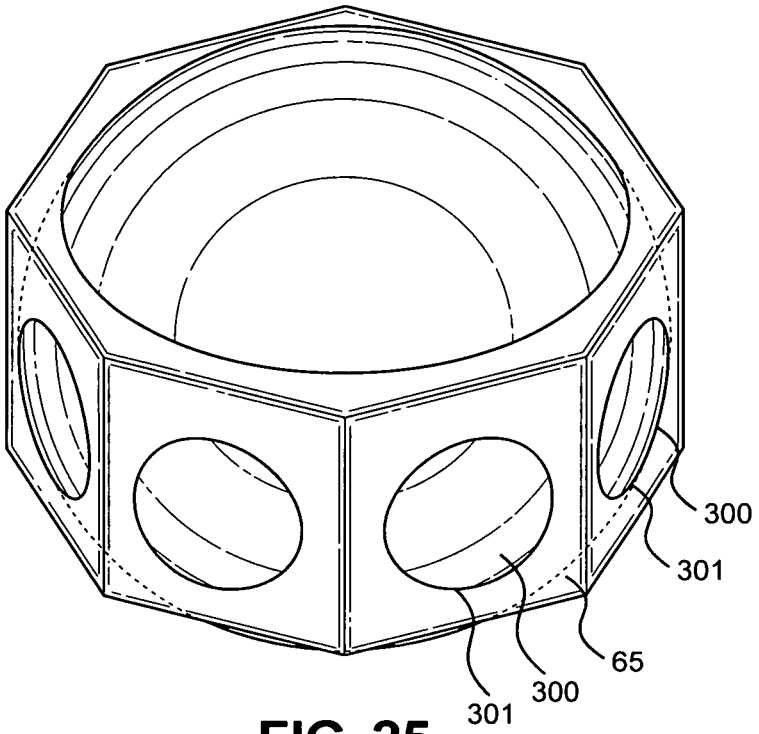
FIG. 25 is a perspective view of an octagon embodiment of the shell of the matching toy.
Figure 26:
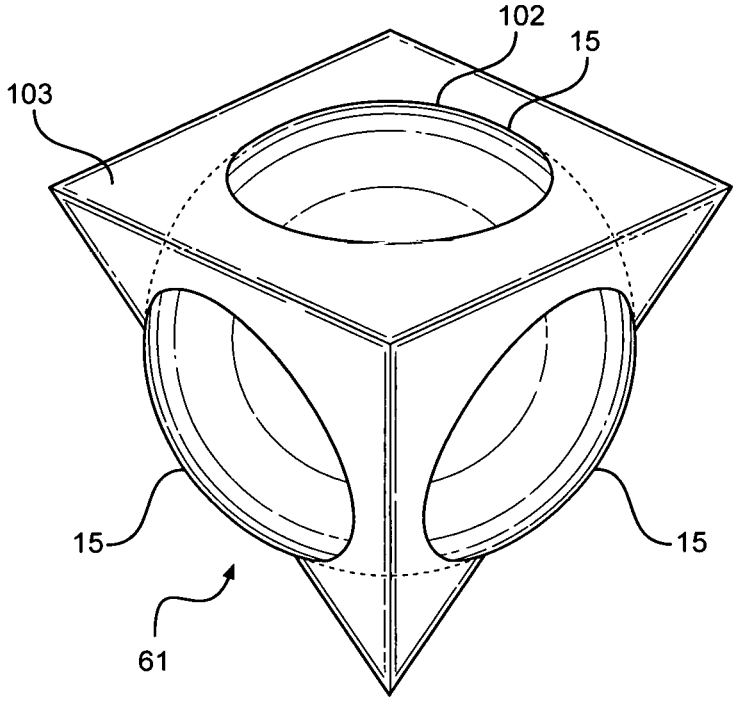

FIG. 26 is an perspective view of an inverted pyramid embodiment of the shell of the matching toy.

The figures depict various embodiments of the described toy and are for purposes of illustration only. One skilled in the art will readily recognize from the following discussion that alternative embodiments of the methods and kits illustrated herein may be employed without departing from the principles of the methods and kits described herein.

DETAILED DESCRIPTION OF THE EMBODIMENT

In the first embodiment, the matching toy 1 is comprised of a shell 2. In one embodiment, the shell 2 is a cube 70 having four sides 3, 4, 5, 6, as well as a top section or side 7 and a bottom section or side 8. Being a cube 70, each side 3, 4, 5, 6 is identical in size with each other, and with the top section 7 and the bottom section 8. In one embodiment, each section or side 7, 8 has a different color. For example, sides 3, 4, 5, 6 are colors red, white, blue and orange, and top section 7 and the bottom section 8 have colors pink and yellow, respectively. Being a cube, the terms "top section" and "bottom section" are used for convenience; all sides in a cube are identical, except for colors or patterns laid on top of or in each side. In another embodiment, each of the eight corners of the cube 404, 405, 406, 407, 408 409, 410, 411, has a different color.

Each of the six sides 3, 4, 5, 6, 7, 8 of the cube 70 has a hole or opening 9, 10, 11, 12, 13, 14. In one embodiment, each of the holes 9, 10, 11, 12, 13, 14 is round. In another embodiment, each of the holes is square and in another embodiment, there can be a mixture of square (or rectangular) and round holes. To give some idea as to dimensions, in one embodiment, cube is 1⅞" on each side, and the round hole on each side is 1⅜" in diameter. In another embodiment, other hole shapes are possible. Within the inside of the cube 2 is a sphere 15. The diameter of the sphere 15 is greater than the width of the cube 2 while still fitting within said cube 2. More specifically each spherical cap 16, 17, 18, 19, 20, 21 of the sphere 15 extends or projects through one of the openings 9, 10, 11, 12, 13, 14. There is enough room or "give" between the edges 22, 23, 24, 25, 26, 27 of the holes or openings 9, 10, 11, 12, 13, 14 to allow the sphere 15 to rotate.in any direction within the cube. It should be noted that the sphere 15 and the cube 70 within which the sphere "fits" have the same volume. In one embodiment, for the purposes of construction, the cube 70 is molded into a top hemisphere 50 and a bottom hemisphere 51, with each of the two hemispheres having eight structurally equally shaped and sized sections 52, 53, 54, 55 56, 57 58, 49. It should also be noted that the caps are integral with the sphere 15 and just describe that part of the sphere 15 sticking out from the openings in the cube 70 or other polygons; hence, the terms "cap" and "sphere" appear to be used interchangeably in some of the figures.

In another embodiment, there is a ball bearing 400 or small metal ball around which the eight structural sections 52, 53, 54, 55, 56, 57, 58 59 fit. This arrangement allows for rotation of a hemisphere along the X axis 401, a Y axis 402, and a Z axis 403, with or without the ball bearing 400. In yet another embodiment, there can be repetitive colors.

In one embodiment, the cube 70 has two separable sections, a bottom section 59 and a top section 60. Other embodiments may include four different sections. With either the sphere 15 or the cube 17 there can be many methods of molding the plastic, or if the toy is made out of wood or metal, creating the toy by other means known in the art.

Once the hemisphere 15 is assembled and put into the bottom section 59 of the cube 70, the top section 60 of the cube 70 can be permanently affixed to the bottom section 59, if such permanence is so desired.

It should be noted that the hemisphere 15 can be molded in one piece for simple matching sequences. The outside print or paint of the hemisphere 15 as well as the cube 70 can be applied by any means known in the art, In one embodiment, the sphere 15 has the same colors and same number of different colors as each of the sides 3, 4, 5, 6, 7, 8 of the cube 2. The sphere 15 is capable of being rotated in any direction within the cube 2 so that the colors of the sphere 15 are capable of being matched with the colors of the sides 3, 4, 5, 6, 7, 8.

In another embodiment, each corner 404, 405, 406, 407, 408, 409, 410, 411 of the cube 70 has a different color, and each sphere section 52, 53, 54, 55, 56, 57, 58 59 has a different color which matches a color of the corner 404, 405, 406, 407, 408 409, 410, 411 of the cube 70. The entire sphere 15 can be rotated within the cube, and there can be rotation along the X 401, Y 402 and Z 403 axis, so as to allow for the matching of the colors.

In yet another embodiment, there are repeating colors in both the corners 404, 405, 406, 407, 408, 409, 410, 411 and in each sphere section 52, 53, 54, 55, 56, 57, 58, 59, ranging from two to eight colors.

It should be noted that instead of, or in addition to, colors being matched, patterns 30, letters 31, numbers 32, words 33, objects 34, geographic shapes, and geometric shapes 35. can be matched. Matching chemical formulas and matching geographic maps can be matched. In one embodiment, photographs can be matched. In yet another embodiment, there may be half a chemical formula, letter, word(s), object, number, pattern, geographic or geometric shape, such that the sphere is rotated to match up the various components. In yet another embodiment, there could be multiple patterns, formulas, numbers, etc. on each of the sides 3, 4, 5, 6, 7, 8 that are to be matched up when the sphere 15 is appropriately aligned with the matching sides 3, 4, 5, 6, 7, 8. Any combination of subject matter may be used. In an alternative embodiment, the patterns 30, letters 31, numbers 32, words 33, objects 34, geographic shapes, and geometric shapes 35, can be positioned in the corners 404, 405, 406, 407, 408, 409, 410, 411 of the cube 70, with the appropriate matching patterns on sphere sections 52, 53, 54, 55, 56, 57, 58, 59. The markings can all be different, or there can be repreating markings. There can be from two to eight different markings to be matched.

In yet another embodiment, there can be a mixture of markings, patterns and colors in a single cube.

In another embodiment, the corners 37, 38, 39, 40, 41, 42, 43, 44 are rounded to reduce the risk of injury.

Both the cube 70 and the sphere 15 are made out of plastic. In another embodiment, both the cube 70 and the sphere 15 are made of wood or metal, resin, or any other material.

In yet another embodiment of the disclosure, a sphere 200 is positioned within a liquid 201, which itself is positioned within a sealed lining 202, such that the sphere 200 has a smaller volume and in fact fits within the cube 270, or polygon, or even an outer hollow sphere 280, which, like the cube has the colors and/or patterns around the sphere 280 or even a small cube 281 floating around. In one embodiment, the liquid 201 is clear in color. In other embodiments, the liquid 201 has a transparent dye. The sealed lining 202 is also clear, and can be made out of plexiglass, glass, or clear plastic. In another embodiment, the sealed lining 202 can be tinted, as long as colors, are being matched up.

The sealed lining 202 is affixed to the inside of a cube 203, with the cube 270 having windows, 254, 255, 256, 257 258, 259 on each side of the cube 253. The windows 254, 255, 256, 257, 258, 259 could be just open spaces as the sealed lining is affixed to the inside of the cube 53, or there could be plastic inserts within the window. As before, on each side of the cube 270 is a different color and pattern, and the sphere 200 has, as well, the appropriate matching colors and patterns. The cube is shaken or spun until the sphere is positioned so that the sides and the spheres match up.

In yet another embodiment, an inner sphere 90 with the appropriate markings can be positioned in a fluid within a sealed container 91 which fits within an outer sphere 92 with a plurality of windows 93-96, for example. The sealed container 91 is affixed to the inside of the outer sphere 92, and both the inner and outer spheres have matching patterns on the various angles of the spheres. The inner sphere 90 is floating in the liquid 201.

In yet another embodiment, there can be other polygonal shapes used in place of the cube 15. In an alternative embodiment, the outer shell 60, in addition to being a cube 70, can be a pyramid 61 a pentagon 62, a hexagon 63, a septagon 64, an octagon 65, or any other polygon. While not numbered for reasons of simplicity, each side of each polygon has an opening 300 and a cap 301 protruding from each side; there is, however, always the option of not having an opening on each side. In each of these embodiments, there is a top section 67 and a bottom section 68. It should be noted that the more sides of a polygon that are present, the smaller the spherical cap. Additionally the height of the various non-cubed polygons may vary, If the height of the various non-cubed polygons are short enough, there can be openings 300 in the top section 67 and bottom section 68 of the polygon, allowing for caps 301 to be positioned through the openings. As stated infra, the caps 301 are integral with the sphere 15 and just describe that part of the sphere 15 sticking out from the openings in the polygons; hence, cap 301 and sphere 15 appear to be used interchangeably in some of the figures.

In another embodiment, the height of the sides is so high that there can be no openings on the top section 67 and bottom section 68 of the polygonal shell 2. As with the cube 70, there could be a sealed liquid form of the toy, with the sphere being encased within the polygon. In the case of the pyramid, there is no opening 101 at the top of the pyramid 61, unless the top is "cut off" and in another embodiment, there may be an opening 102 on the bottom floor 103 of the pyramid 61.

It should be noted that the polygons and globe shaped disclosures can be made out of plastic, metal, wood, or combinations thereof. They can be of any size.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments, but should be defined only in accordance with the following claims and their equivalents.

We claim:

1. A matching toy, said matching toy comprising:

a) a sphere;

b) a cube, said cube comprising six sides, each side comprising four corners wherein at least two corners are of a different marking, wherein each of said six sides have an opening, said sphere positioned within said cube, such that when said sphere is within said cube, a cap of said sphere projects out each said opening; and said sphere equally divided into eight cube sections with each of said cube sections comprising one of said markings capable of matching to one of said marking of each of said corners, such that when completely matched, the markings of each one of the sections of the sphere matches with the markings on one of the corners, such that each sphere section is matched with one said corner.

2. The matching toy of claim 1, wherein said cube has the same volume as the sphere.

3. The matching toy of claim 1, wherein said toy is made out of a material selected from the group consisting of plastic, wood, and metal.

4. The matching toy of claim 1, wherein said marking is selected from the group consisting of: colors, patterns, letters, numbers, words objects, geographic shapes, geometric shapes, matching chemical formulas, matching geographic maps, matching photographs, matching chemical formulas, matching letters, matching letters, matching photographs, matching geographic shapes, and combinations thereof.

5. The matching toy of claim 1, wherein said combination of markings on each side is unique to any other said combination of markings of any other said sides.

6. A matching toy, said matching toy comprising:

a) a sphere;

b) a polygon, wherein at least two corners are of any side of the polygon have different markings, wherein each said side has an opening, and each side having a marking, said sphere positioned within said polygon, such that when said sphere is within said polygon, a cap of said sphere projects out each said opening; and c) said sphere divided into sections equal to a summation of a total number of corners of each side of the polygon with each of said sections comprising one of said markings capable of matching to one of said marking of each of said corners, such that when completely matched, the markings of each one of a sphere's sections matches with the markings on one of the corners, such that each section is matched with one said corner.

* * * * *